US006076042A

United States Patent [19]

Tognazzini

[11] Patent Number: 6,076,042

[45] **Date of Patent: *Jun. 13, 2000**

[54] ALTITUDE SPARSE AIRCRAFT DISPLAY

[75] Inventor: Bruce Tognazzini, Woodside, Calif.

[73] Assignee: Sun Microsystems, Inc., Palo Alto, Calif.

[ * ] Notice: This patent is subject to a terminal disclaimer.

[21] Appl. No.: 09/174,246

[22] Filed: Oct. 16, 1998

Related U.S. Application Data

[63] Continuation of application No. 08/639,819, Apr. 29, 1996, Pat. No. 5,884,223.

[51] Int. Cl.[7] ..... G08G 5/04

[52] U.S. Cl. ..... 701/301; 340/961; 342/29; 342/455

[58] Field of Search ..... 701/300, 301, 701/3, 4; 340/945, 961, 963, 967, 970; 342/29, 30, 31, 32, 455

[56] References Cited

U.S. PATENT DOCUMENTS

| | | | |
|---|---|---|---|
| 4,464,244 | 8/1984 | Bateman et al. | 701/301 |
| 5,077,673 | 12/1991 | Brodegard et al. | 701/301 |
| 5,414,631 | 5/1995 | Denoize et al. | 701/301 |
| 5,448,233 | 9/1995 | Saban et al. | 701/301 |
| 5,488,563 | 1/1996 | Chazelle et al. | 701/301 |
| 5,515,286 | 5/1996 | Simon | 701/301 |
| 5,631,640 | 5/1997 | Deis et al. | 342/29 |
| 5,636,123 | 6/1997 | Rich et al. | 701/301 |
| 5,638,282 | 6/1997 | Chazelle et al. | 701/301 |
| 5,677,842 | 10/1997 | Denoize et al. | 701/301 |
| 5,884,223 | 3/1999 | Tognazzini | 701/301 |

*Primary Examiner*—Gary Chin
*Attorney, Agent, or Firm*—McDermott, Will & Emery

[57] ABSTRACT

A system, method, apparatus, and computer program product for avoiding aircraft collisions with stationary obstacles. The aircraft is provided with a simplified uncluttered onboard display of all objects which are in or proximate to the projected path of the aircraft at its particular altitude plus or minus a predetermined increment, such as 100 feet constituting a hazard zone. The display presents the hazards in that zone in geographical relationship to the position and path of the aircraft. In addition to the obstacles in the hazard zone the display may also present topographical features of the underlying terrain. This information is in the form of a muted presentation of a topographical moving map. As the aircraft approaches a hazard in the hazard zone the presentation of the obstacles or hazards within the zone is enhanced to draw increasing attention of the pilot. When the aircraft arrives at the periphery of a predetermined hazard avoidance maneuver area where evasive action is imperative, the display undergoes a dramatic change. A further feature of the system may give an audible warning in addition to audible directions as to the action to be taken to avoid collision.

32 Claims, 6 Drawing Sheets

ALTITUDE SPARSE AIRCRAFT DISPLAY

This application is a continuation of application Ser. No. 08/639,819 filed Apr. 29, 1996, now U.S. Pat. No. 5,884, 223.

BACKGROUND OF THE INVENTION

1. Field of the Invention

The invention relates to a system, method, apparatus, and computer program product for avoiding aircraft collisions and more particularly to a system, method and apparatus for avoiding collision with stationary obstacles.

2. Description of Related Art

Aircraft safety is principally a matter of preventing collisions with other aircraft, obstructions and the ground. Air traffic control is provided in virtually all modern airports and is the product of the National Air Space System (NAS) in the United. States. Such control involves many elements including air-to-ground communications and both airborne and ground mounted electronic equipment. Air navigation also entails airborne and ground mounted electronic equipment and systems. Examples of such systems currently in use include: omni-directional radio range (VOR) stations, VORTAC or VOC/DME stations, doppler radar, inertial navigation systems, Loran C, Omega, NAVSTAR GPS, microwave landing systems (MLS), non-directional beacons (NDB), radar, and tactical air navigation (TACAN). While NAVSTARGPS is widely utilized by surface craft for marine navigation, and is in use by the U.S. military, it has not to date been adapted to commercial aircraft use. The aforelisted aircraft navigation systems may be used in conjunction with a flight management computer system (FMCS) which combines the capabilities of a navigation computer and those of an aircraft performance computer. The FMCS may perform only the area navigation function, but is more likely to utilize inputs from several sensors when they are installed and available, such as VOR/DME, Loran C, Omega/VLF, TACAN and an inertial reference system. Unless the pilot manually selects a specific navigation aid to be used (such as VOR/DME), the computer conventionally will follow a selection hierarchy, with cross-checks to other aids. In the event that no reliable external navigation aid is available, the navigation computer will go into an inertial navigation mode.

Aircraft collision avoidance systems are generally independent of ground-based systems and are intended to allow the pilot of an aircraft to observe and avoid other aircraft, regardless of weather. In civil aviation aircraft are presently kept separated by the use of communication, navigation, and a surveillance system based on the ground. The earliest type of airborne equipment comprised airborne radar. However, it soon became apparent that at the radio frequencies low enough to penetrate heavy rain (below about 10 GHz), the antenna size would have to be prohibitively large in order to resolve the angular difference between a collision course (no change of bearing) and a potentially passing course (small change of bearing). In the early 1960's so-called black boxes were provided on aircraft to provide warning based on the distance between aircraft and their rate of closure.

Since the mid-1970's efforts have concentrated on the use of hardware already carried by most aircraft, namely, the transponder of the air-traffic control radar beacon system (ATCRBS). These transponders reply to interrogations from secondary surveillance radars (SSRs) on the ground. For an independent collision avoidance system, it was proposed to interrogate these transponders from the air (in addition to continuing to reply to interrogations from the surveillance radar). This system is known as the traffic alert and collision avoidance system (TCAS). In a TCAS equipped aircraft, replies are fed to a computer which generates two types of information: (1) traffic advisories that tell the pilot there are nearby aircraft of known distance, altitude and approximate bearing; and (2) resolution advisories that advise immediate evasive action (for example, "climb" or "descend"). These are displayed to the pilot by various means, depending on customer preference, and have included synthetic voice, modification of the weather radar display, and modification of the vertical speed indicator.

The Problems

While the foregoing systems provide reasonable safety when used for their intended purposes, none of these systems effectively avoid crashes into mountainous terrain or ground hazards where the pilots are lost or mistaken as to their present position. This is particularly true in attempting landing at airports proximate to such hazards with which the pilots are unfamiliar. An example is a recent incident where a commercial civil aircraft turned into a mountain in South America. There is thus a need for providing an improved system, method and apparatus for avoiding aircraft collision with stationary ground hazards.

Commercial aircraft developed during the 1980s used digital electronics usually embodied in an integrated flight management system (FMS). Such a system includes automatic flight control, electronic flight instrument displays, communications, navigation, guidance, performance management, and crew alerting to improve safety, performance and economics. In order for a pilot to effectively fulfill the role of flight manager he/she must have ready access to relevant flight information and suitable means to accomplish aircraft control within reasonable workload bounds. The extensive data-processing capabilities and integrated design of a flight management system provide the pilot with access to pertinent information and a range of control options for all flight phases. The basic elements of such an integrated flight management system are shown diagrammatically in FIG. 1.

Referring to that figure the avionics may be subdivided into three basic groups: sensors, computer subsystems and cockpit controls/displays. FIG. 1 shows the intrasystem communication data buses diagrammatically at 10. The cockpit control operate the sensors and computer subsystems, and the displays are supplied with raw and processed data from them. Illustrative radio sensors are shown at 12, air data computers at 14, flight management computers (FMC) at 16, caution and warning computers at 18, and flight control computers at 20. The FMC computers provide input to a control display unit 22 while the caution and warning system provides input to a caution and warning display 24. Electronic attitude director indicator (EADI) is shown at 26 and an electronic horizontal situation indicator (EHSI) is shown at 28. The electronic horizontal situation indicator may include map and weather radar (WXR) displays. Other displays such as the mach/airspeed indicator (M/ASI), radio directional magnetic indicator (RDMI), instantaneous vertical speed indicator (IVSI), and thrust indicator are indicated generally at 30. The inertial reference unit is indicated at 32, while the communication systems, such as VHF, HF, and air traffic control, are indicated at 34. Control panels are shown generally at 36 providing control of such systems as the electronic flight instrument system (EFIS), inertial reference system (IRS), instrument landing system (ILS), navigation, communication, and weather radar (WXR) systems. A control system electronic unit is shown at 38 and an autopilot is shown at 40.

The electronic attitude director indicator (EADI) provides a cathode ray tube display of information including attitude information showing the aircraft's position in relation to the instrument landing system or a VHF omnirange station. In addition, the EADI indicates the mode in which the automatic flight control system is operating and presents the readout from the radio altimeter. Ground speed is displayed digitally at all times near the air speed indicator.

The electronic horizontal situation indicator (EHSI) provides an integrated multicolor map display of the aircraft's position, plus a color weather radar display. Wind direction and velocity for the aircraft's present position and attitude, provided by the inertial reference system, are shown at all times. Both the horizontal situation of the airplane and its deviation from the planned vertical path are also provided, thus making it a multidimensional situation indicator. The EHSI operates in three primary modes, namely, as a map display, a full compass display, and a VOR mode that displays a full or partial compass rows. The map displays are configured to present basic flight plan data, including such parameters as the route of flight, planned weight points, departure or arrival runways, and tuned navigational aids. Predictive information is also displayed. Thus, the EHSI may provide a display of a prediction of the path over the ground on the basis of current ground speed and lateral acceleration. A second prediction may be an attitude range arc used for climb or descent to show where the aircraft will be when the target altitude is reached. This feature allows the pilot to quickly assess whether or not a target altitude will be reached before a particular location over the ground.

The essential display elements of a typical alerting system for aircraft is a cathode ray tube with a multicolor capability located at a point easily viewable from a pilot's position such as on the pilot's forward main engine instrument panel. Two colors are generally used, one for warnings (emergency operational or aircraft system conditions that require immediate corrective or compensatory action by the crew) which may be presented in red alphanumerics; cautions, conditions that require immediate crew awareness and eventual corrective or compensatory action and advisories may be presented with amber alphanumerics.

Military aircraft have instrumentation requirements which include essentially the instrumentation described above in addition to instrumentation for the performance of special mission needs. The latter category of displays include a head-up display in the forward field of view and a radar map display, presenting radar reflections of ground imagery and targeting information. The control panel display may include a moving map, i.e. an electronic map of the area moving below the aircraft.

SUMMARY OF THE INVENTION

The invention provides a system, method, apparatus, and computer program product for avoiding aircraft collisions with stationary obstacles. According to the invention the aircraft is provided with a simplified uncluttered onboard display of all objects which are in or proximate to the projected path of the aircraft at its particular altitude plus or minus a predetermined increment, such as 100 feet. This vertical sector constitutes the hazard zone. The display presents the hazards in that zone to the pilot in accurate geographical relationship to the position and path of the aircraft. In addition to the obstacles in the hazard zone the display may also present simplified information with respect to underlying topographical features of the terrain. This information is preferably in the form of a muted presentation of a topographical moving map of the area underlying and ahead of the aircraft.

As the aircraft approaches a hazard in the hazard zone the presentation of the obstacles or hazards within the zone is modified to draw increasing attention of the pilot. Such modification may take the form of color and brightness changes and increasing contrast between the presentation of the objects within the hazard zone and the topography below. When the aircraft arrives at the periphery of a predetermined hazard avoidance maneuver area where evasive action is imperative, the display undergoes a dramatic change. In a preferred form of the invention this may comprise all detail other than the hazard and aircraft disappearing from the screen. At the same time the background color may change to make even more dramatic the alteration of the appearance of the display. This occurrence should draw the attention of the pilot to the fact that an emergency is at hand and evasive action is necessary.

At this time the display shows only objects within the hazard zone in the path of the aircraft. The pilot is thus presented with a single display of uncluttered basic information making possible a virtually immediate decision as to whether or not a left or right turn would escape collision with the hazard. It is a further feature of the invention that the system may give an audible warning in addition to audible directions as to the action to be taken to avoid collision. These directions may be positive, as directing a particular evasive action, or negative, as in detecting an erroneous evasive action and warning that it must be reversed. In an ultimate situation the invention also may provide for automatically placing the autopilot in control and directing the correct evasive action.

Still other objects and advantages of the present invention will become readily apparent to those skilled in the art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

NOTATIONS AND NOMENCLATURES

The detailed descriptions which follow may be presented in terms of program procedures executed on a computer or network of computers. These procedural descriptions and representations are the means used by those skilled in the art to most effectively convey the substance of their work to others skilled in the art.

A procedure is here, and generally, conceived to be a self-consistent sequence of steps leading to a desired result. These steps are those requiring physical manipulations of physical quantities. Usually, though not necessarily, these quantities take the form of electrical or magnetic signals capable of being stored, transferred, combined, compared, and otherwise manipulated. It proves convenient at times, principally for reasons of common usage, to refer to these signals as bits, values, elements, symbols, characters, terms, numbers, or the like. It should be noted, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary, or desirable in most cases, in any of the operations described herein which form part of the present invention; the operations are machine operations. Useful machines for performing the operation of the present invention include general purpose digital computers or similar devices.

The present invention also relates to apparatus for performing these operations. This apparatus may be specially constructed for the required purpose or it may comprise a general purpose computer as selectively activated or reconfigured by a computer program stored in the computer. The procedures presented herein are not inherently related to a particular computer or other apparatus. Various general purpose machines may be used with programs written in accordance with the teachings herein, or it may prove more convenient to construct more specialized apparatus to perform the required method steps. The required structure for a variety of these machines will appear from the description given.

DETAILED DESCRIPTION OF THE INVENTION

Figure 2:
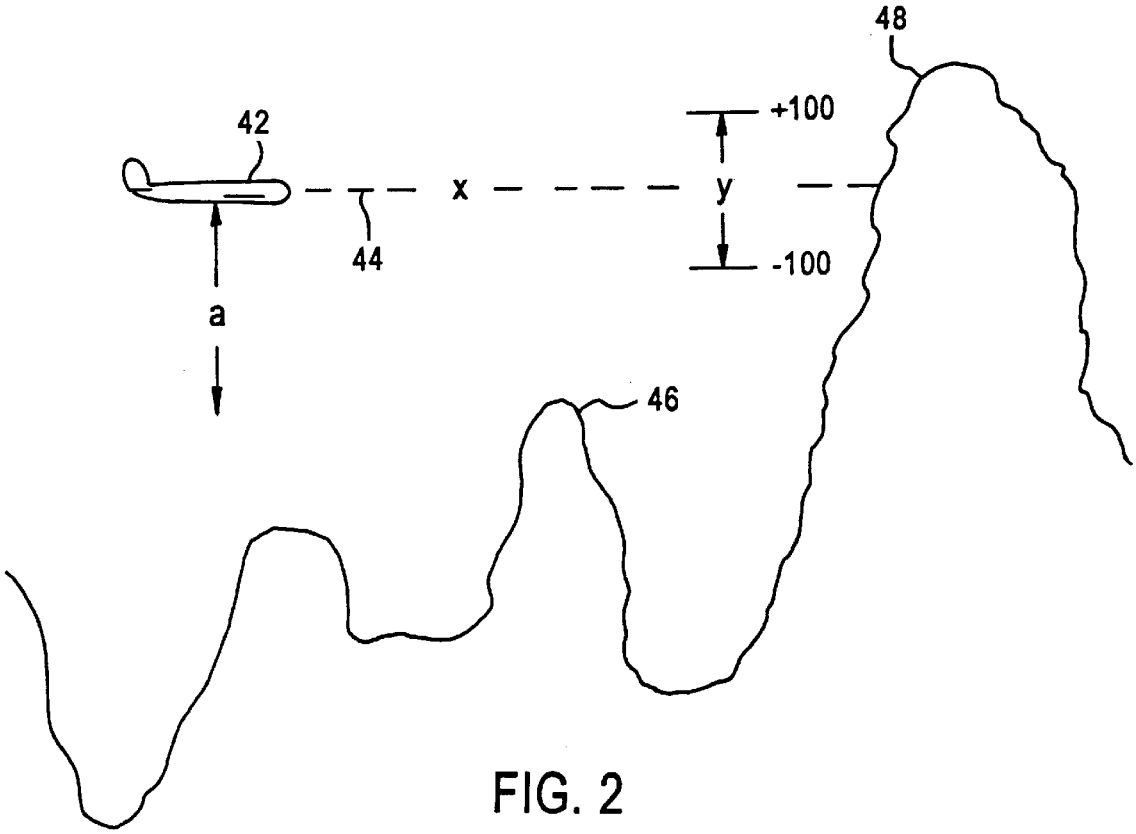
FIG. 2 is a vertical elevation of an aircraft in flight over mountainous terrain.

Referring to FIG. 2 there is shown an aircraft in flight on a level path indicated by the broken line 44 at an altitude "a" over a terrain 46. As shown in the drawing the aircraft is a distance x from a hazard in the form of a mountain or hill 48 upstanding from the terrain 44. It will be obvious from FIG. 2 that the higher the altitude the more sparse are the hazards and vice versa. According to the invention the aircraft is provided with an onboard display of all objects which are in or proximate to the projected path of the aircraft at its particular altitude plus or minus a predetermined increment, such as 100 feet. This vertical sector is herein referred to as the hazard zone. The display presents the hazards to the pilot in accurate geographical relationship to the position and path of the aircraft. In addition to the obstacles in the hazard zone the display may also present topographical information with respect to underlying topographical features of the terrain. This information is preferably in the form of a muted presentation of a topographical map of the area underlying the aircraft. While the principal area of interest is ahead of the aircraft it is also desirable to have access to topographical information regarding the terrain to the sides and rear of the aircraft in the event that a complete or partial course reversal becomes desirable.

As the aircraft approaches the hazard 48 and the distance-to-hazard dimension "x" diminishes, the presentation of the obstacles within the hazard zone "y" is modified to draw increasing attention of the pilot. Such modification may take the form of color and brightness changes and increasing contrast between the presentation of the objects within the hazard zone "y" and the topography below. As the aircraft approaches the hazard 48 and reaches a position where evasive action is imperative the display undergoes a dramatic change. In a preferred form of the invention this may comprise all detail other than the hazard disappearing from the screen. At the same time the background color may change to make even more dramatic the alteration of the appearance of the display. This occurrence should draw the attention of the pilot to the fact that an emergency is at hand and evasive action is necessary.

Figure 3:
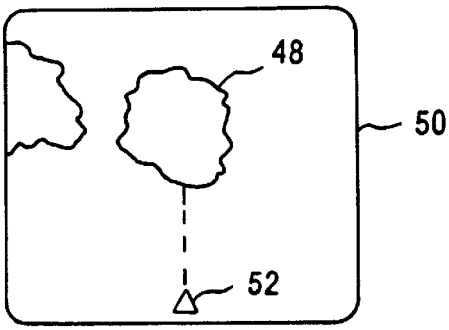
FIG. 3 is an illustration of a display according to a preferred embodiment of the invention.

At this time the display shows only objects within the hazard zone in the path of the aircraft. The pilot is thus presented with a single display of uncluttered basic information making possible a virtually immediate decision as to whether or not a left or right turn would escape collision with the hazard. An exemplary display presentation is shown in FIG. 3. Referring to that figure the display 50 shows the aircraft at 52 and a highlighted plan view of the hazard 48 in the course of the aircraft. In order to provide even further visual attraction the display may show the hazard in a brightened or multicolored fashion which may also be presented in blinking form. The rapid and dramatic change in appearance of the display 50 will attract the attention of the pilot while the simplified display presentation will immediately indicate that collision may be avoided by a right turn. As an additional feature of the invention the warning provided by the system may be audible as well as visual. Still further, standard collision avoidance algorithms may be utilized to provide audio directions to the pilot. These may be either or both positive directions, such as "turn right now", or negative directions responsive to an erroneous action commenced by the pilot, such as "don't turn left." In an extreme situation the system may provide for automatic assumption of control of the aircraft by the autopilot to execute the necessary collision avoidance action.

Figure 1:
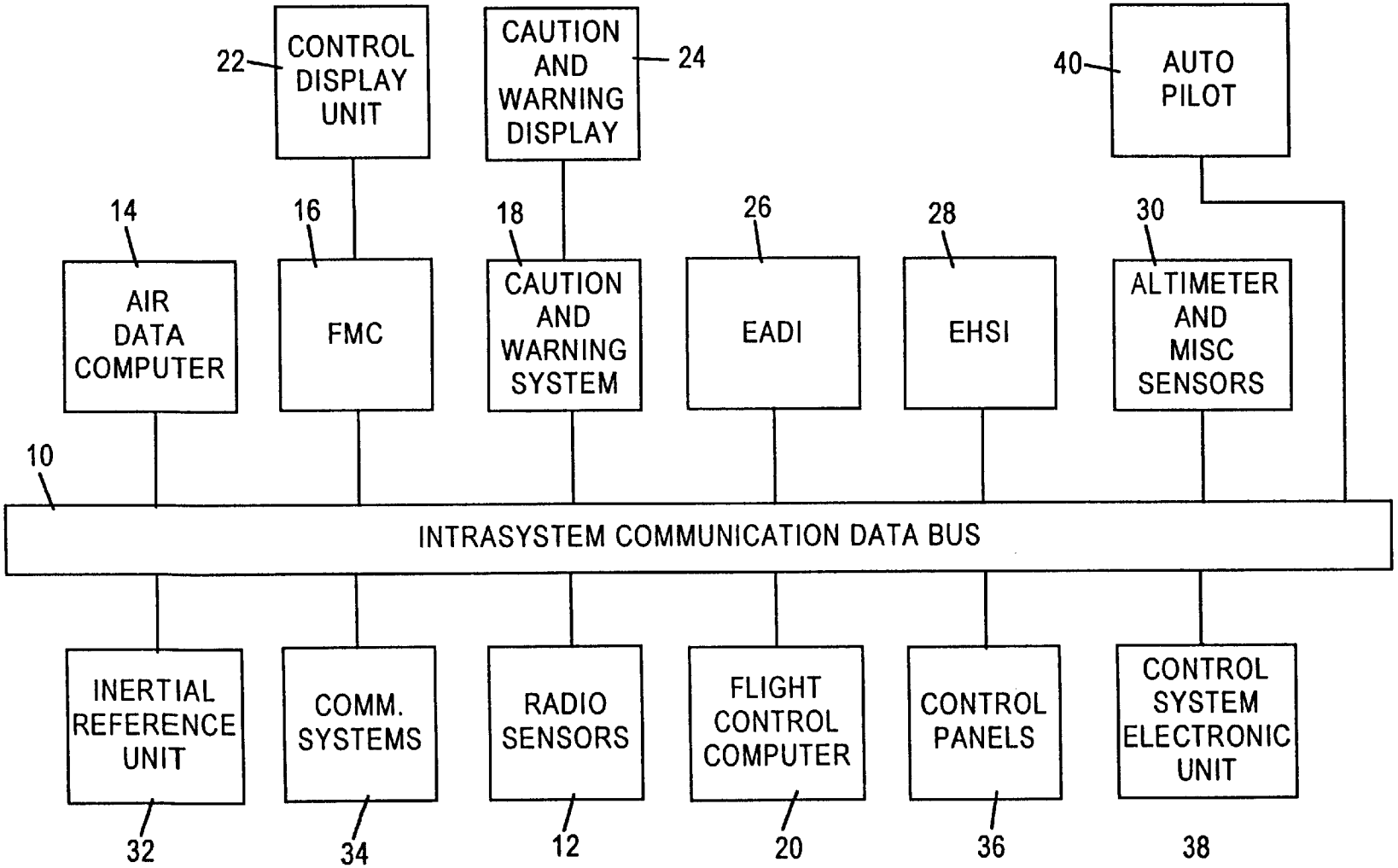
FIG. 1 is a diagrammatic illustration of the basic elements of a conventional integrated flight management system.
Figure 4:
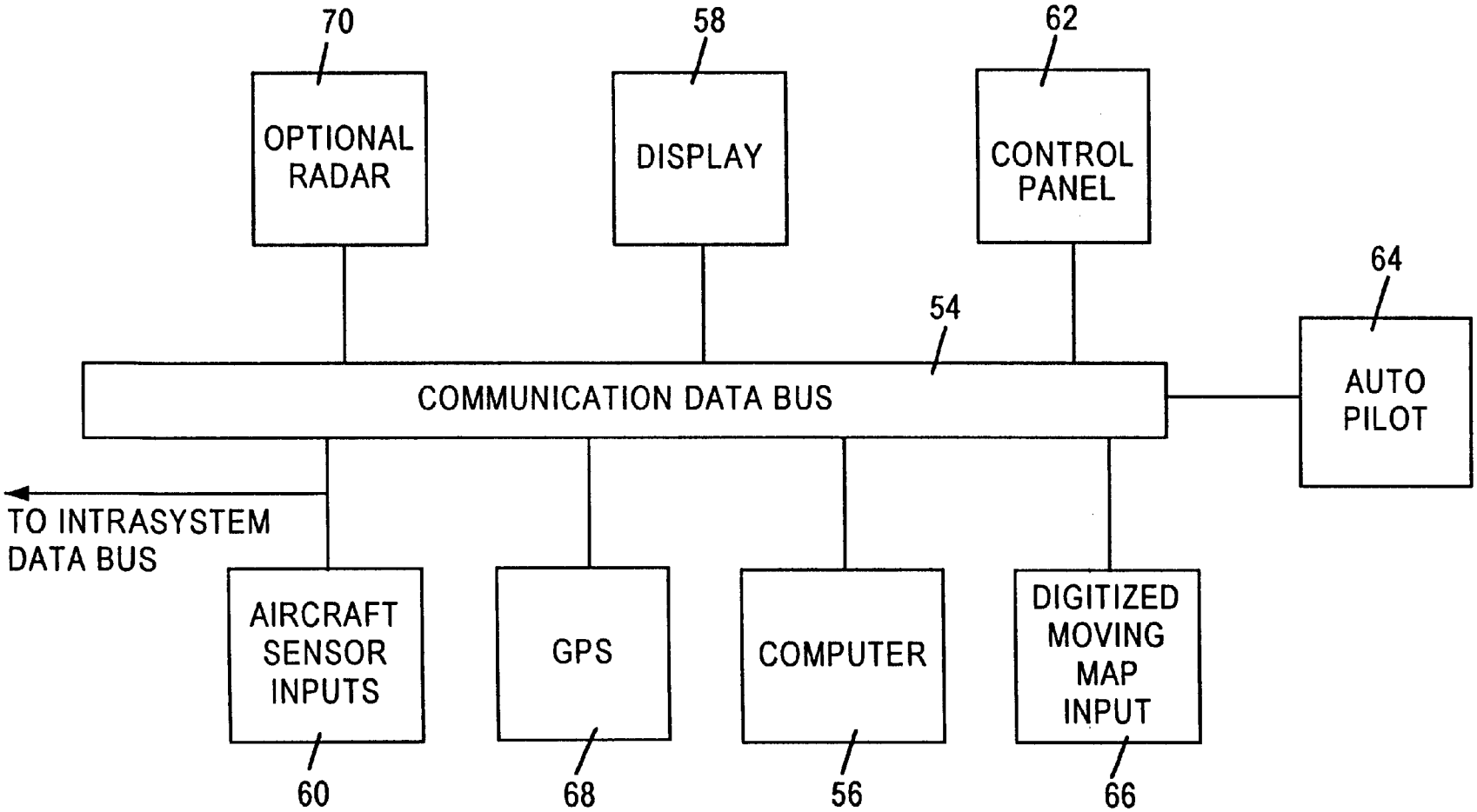
FIG. 4 is a diagrammatic illustration of a preferred embodiment of the system of the invention.

Referring to FIG. 4, there is shown a diagrammatic illustration of a system for implementing the instant invention. That figure shows the intrasystem communication data buses diagrammatically at 54. The hazard management computer 56 integrates the hazard management functions presently to be described. A hazard management display 58 is preferably strategically placed in the aircraft cockpit in such a position as to well within the normal field of vision of the pilot. It will be obvious to those skilled in the art that multiple displays may be provided for the copilot and aircrew. The aircraft sensor inputs are indicated at 60 and would normally provide aircraft velocity, direction, rate of climb/descent, altitude and related functions. A connection to the intrasystem communication data buses 10 in FIG. 1 may be provided for obtaining these and additional aircraft parameter inputs. These may include such characteristics as the minimum turn radius of the aircraft at various speeds, the rate of climb capability at the existing altitude, speed and engine functionality, the practical rate of deceleration under existing conditions, and the like parameters. It will be obvious that these parameters are condition dependent and in the case of commercial aircraft are also dependent upon passenger comfort and panic reaction threshold. A system control panel is provided at 62 while the autopilot is indicated at 64. A digitized moving map input 66 provides the topographical data for the terrain being traversed.

It is essential to the functioning of the system that the position of the aircraft be accurately known at all times. To this end the preferred embodiment of the invention entails reliance upon the Global Positioning System. This is a space-based triangulation system using satellites and computers to measure positions anywhere on earth. It is primarily a defense system developed by the United States Department of Defense, and is referred to as the "Navigation Satellite Timing and Ranging Global Positioning System" or NAVSTARGPB. The uniqueness of this navigational system is that it avoids the limitations of other land-based systems such as limited geographic coverage, lack of 24-hour coverage, and the limited accuracies of other related navigational instruments. While the system is presently subject to a method of control which limits civilian access to its full capabilities this constraint is presently in the process of elimination. The system is capable of a three dimensional positional accuracy of 16 meters with full access to the military accuracy, and a present civilian accuracy of 100 meters. Economical GPS receivers are readily available. A GPS receiver providing an input to the communication buses 54 is shown at 68. Radar 70 may optionally be used in conjunction with the aircraft position determination system.

As an alternative to or as a redundant system the position of the aircraft may also be determined by an inertial navigation system. Currently available implementations of this system incorporates strap-down inertial techniques and the ring laser gyro. Strap-down inertial techniques eliminate the costly and bulky jumbled stable platform previously used in high-accuracy inertial navigation systems. The laser gyro is unconventional since it does not have a spinning wheel. It detects and measures angular rates by measuring the frequency difference between two contrarotating laser beams.

Figure 5A:
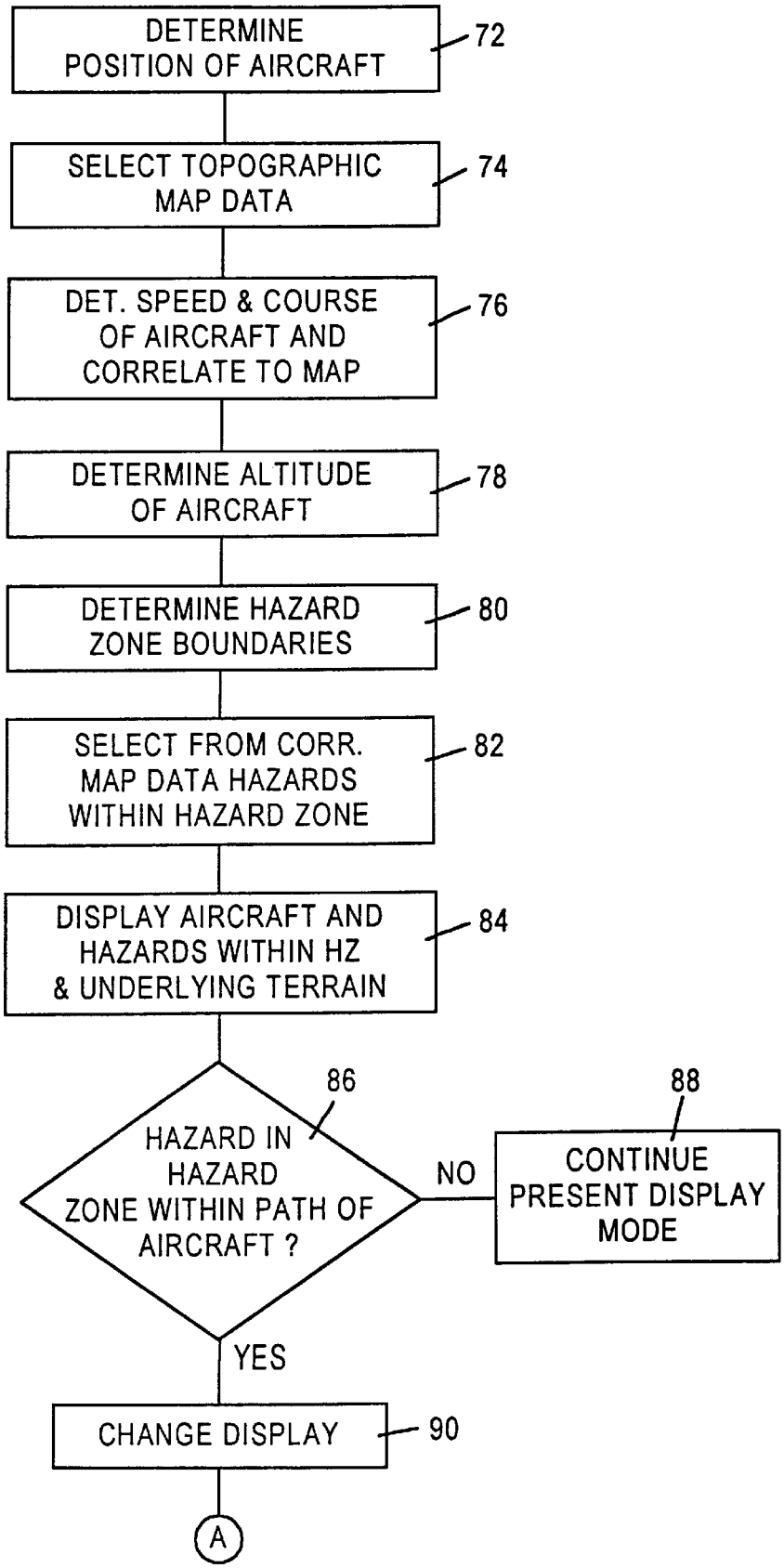
FIGS. 5A–5C are flowcharts illustrating the operation and method of the invention.
Figure 5B:
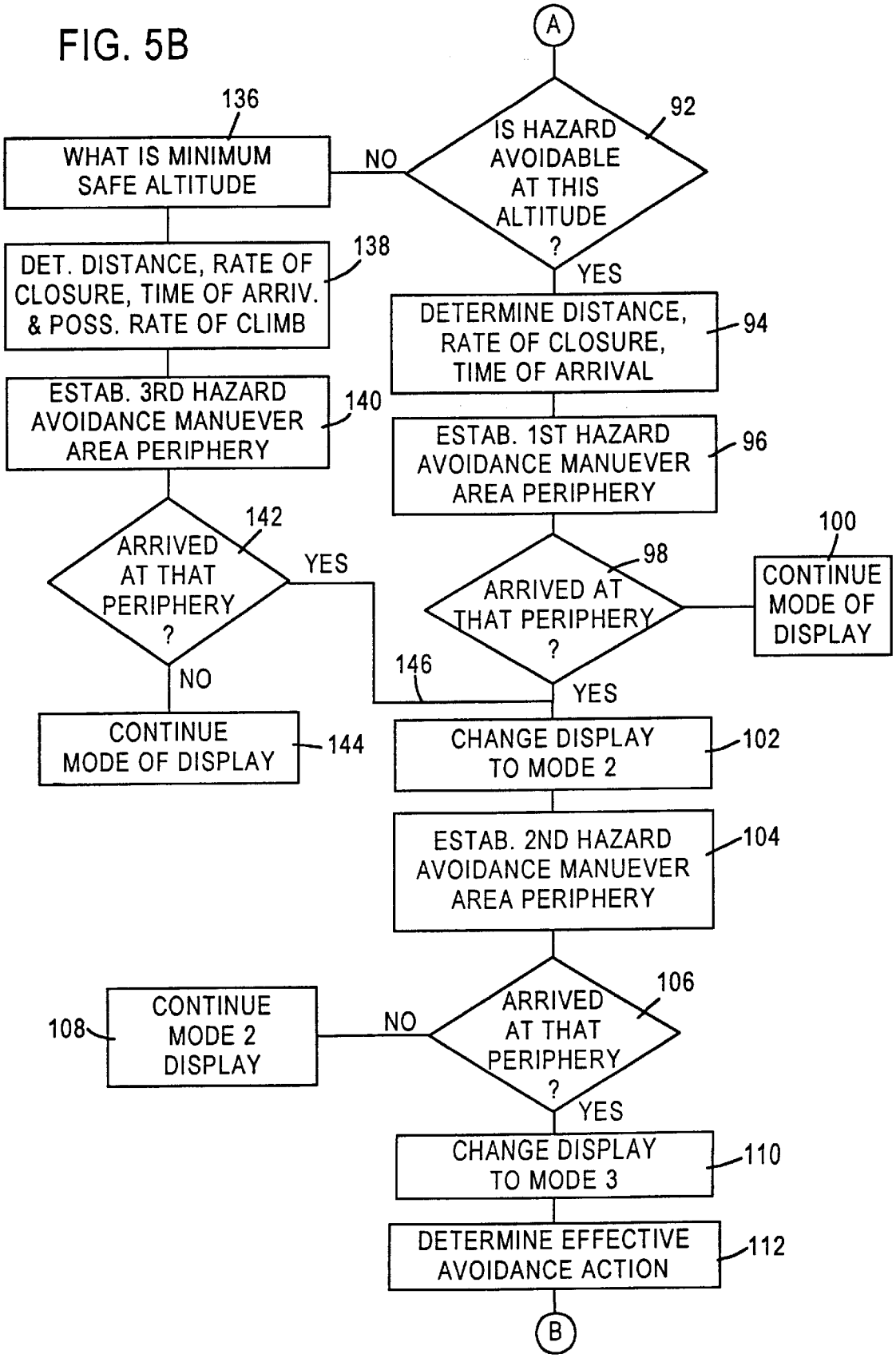
Figure 5C:
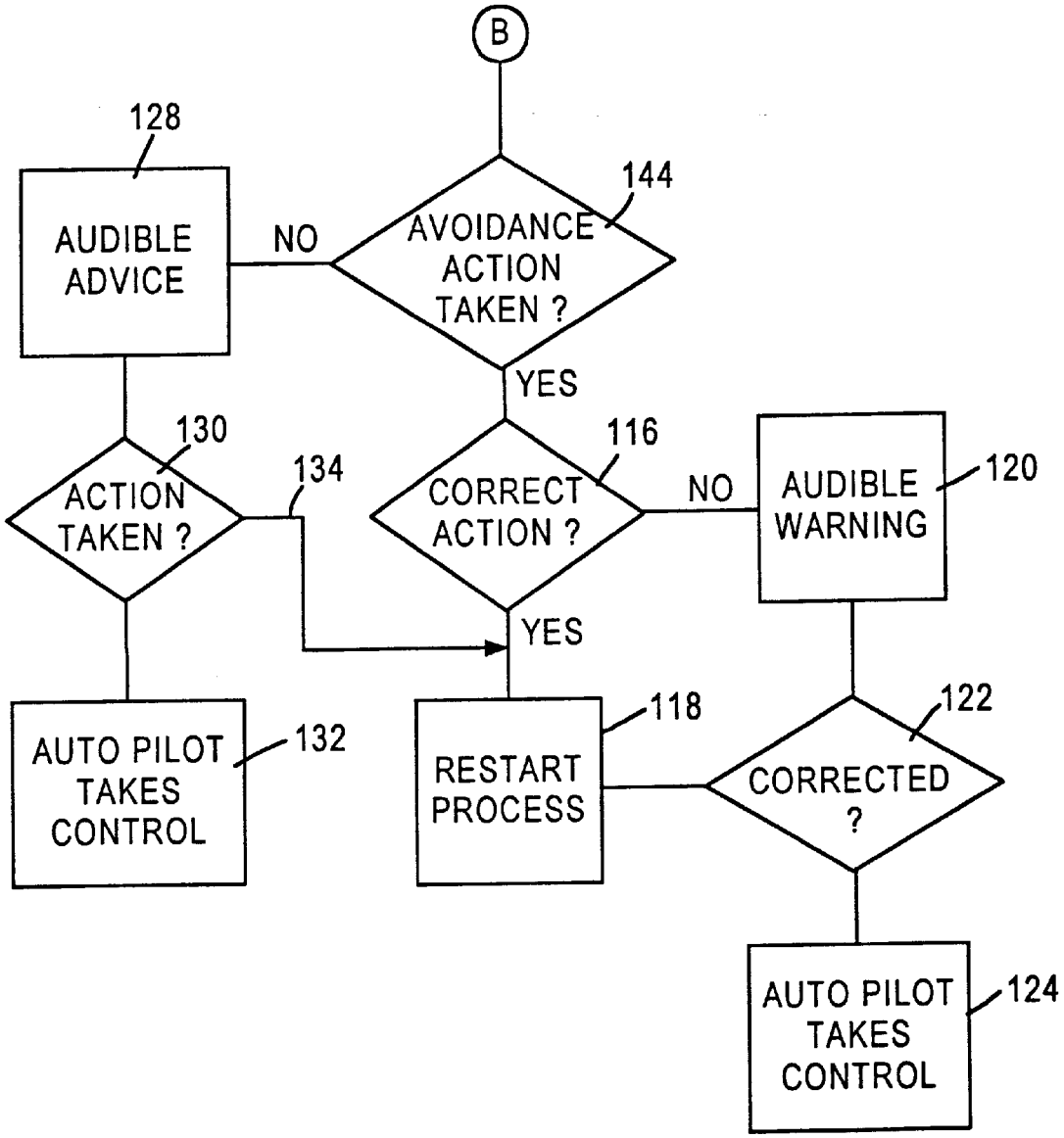

The operation of the system may be described in connection with the flowchart of FIG. 5. Referring to that figure the position of the aircraft is determined at 72 by the GPS and/or inertial reference system. At 74 the map data corresponding to this position is selected for the moving map input. The speed and direction of the aircraft is determined from the appropriate sensors and correlated to the map movement at 76. At 78 the altitude of the aircraft is determined. From this altitude the upper and lower boundaries of the hazard zone (HZ) are determined at 80. By way of example, if the altitude is determined to be 10,000 feet, the hazard zone extends from 9,900 feet to 10,100 feet. This determination is utilized in order to select from the correlated map data the hazards which lie within this hazard zone. This is indicated at 82. The selected hazards are displayed in relationship to the position of the aircraft in a manner such as indicated in FIG. 3.

In a routine flight situation the topography of the terrain below the hazard zone is displayed in a muted fashion relative to the display of the hazards which lie within the hazard zone. The contrast between the two types of display may be provided by differences in color, brightness, line width, etc., so long as there is an obviously apparent visual difference. It is an important feature of the invention that the display be in a simplified form to permit easy assessment by the pilot.

The type of display utilized according to the invention is deliberately in marked contrast to the current electronic horizontal-situation indicator (EHSI) map mode display. That display includes comprehensive information such as magnetic/true north, heading/track annunciator, aircraft track, track mode, flight mode enunciation, aircraft heading, weigh points, manually selected navigational aids, flight path line, curve trend vector, minutes to go, remotely selected heading, track tape and scale, straight trend vector, weather radar display, range scale, aircraft symbol, wind speed and direction, selected airport, weigh point altitude, weigh point speed, altitude range, and track change annunciator. The simple display of the system of the invention established at 84 is referred to as the Mode 1 display.

At 86 the system determines whether or not there is a hazard in the aircraft within a first predetermined distance which defines the perimeter of a first alarm zone. If the determination at 86 indicates that there is no hazard in the path of the aircraft within that distance the Mode 1 display is continued as indicated at 88. If a hazard is detected in the path of the aircraft in the first alarm zone, the display presentation is changed at 90 into a Mode 2 condition. If the invention shares the display with EHSI or other information displays, Mode 2 will typically preempt them. In this condition the contrast between the hazards in the hazard zone and the underlying terrain is increased as by a change in color, brightness of the hazards and/or the background terrain.

At this time the system determines whether the hazard is avoidable at the existing altitude of the aircraft as indicated at 92. If the response at 92 is affirmative the system determines the distance to hazard, rate of closure, and estimated time of arrival at 94. On the basis of this information at 96 the system establishes the distance to a first hazard avoidance maneuver area periphery. At 98 a determination is made as to whether or not the aircraft has arrived at that periphery. If the answer is negative the Mode 1 display is continued as indicated at 100. If the answer is affirmative and the aircraft has arrived at the periphery of the first hazard avoidance maneuver area the display is changed another degree in contrast to a Mode 2 display indicated at 102. This may comprise a further change in color, brightness or contrast between the hazards and the underlying terrain.

At 104 the system determines the periphery of a second hazard avoidance maneuver area. At 106 a determination is made as to whether or nor that periphery has been reached. If the answer is negative the display continues in Mode 2 as indicated at 108. If the answer is affirmative, the display is changed to the Mode 3 emergency condition at 110. At 112 the system makes a determination of effective avoidance action, such as a right or left turn of a specified number of degrees or two a specified course. At 114 the system determines whether or not avoidance action has been undertaken. If the response is affirmative a determination is made at 116 as to whether or not the action taken is the correct action. If the correct action has been taken at 118 the process is restarted by returning to 72 whereby the display presents different terrain and different hazards depending upon the topography and direction of the aircraft.

If the avoidance action taken at 116 is incorrect, an audible warning is delivered at 120 along with audible advice as to the corrective action to be taken. This may be in the form of "You have made an erroneous right turn—immediately turn left to course 130." At 122 the system makes a determination as to whether or not the error has been corrected and if not the autopilot takes control to make the necessary correction at 124. If the appropriate corrective action has been taken at 122 the process is restarted at indicated at 126.

Returning to step 114 and the initial determination as to whether avoidance action has been taken, if the response is negative audible advice is immediately provided at 128. At 130 the system determines whether this advice has been taken and appropriate action implemented. If the response is negative the autopilot takes control at 132. If the correct action has been taken at 130 the process is restarted as indicated at 134.

It will be appreciated that the number of avoidance action areas and the number of modes of display may be increased or decreased. In all events, the display should be in simplified form devoid of distractive detail and presented in a fashion where the correct evasive action will be intuitive to a skilled pilot.

Returning to step 92, the hazard avoidable at this altitude question is based on the assumption that the response will permit ultimate resumption of the base course, it being obvious that the hazard usually could be avoided by reversing course. If the response to the query at 92 is negative, the system next determines the minimum safe altitude for avoidance of the hazard at 136. At 138 a determination is made as to the distance, rate of closure and time of arrival (as in step 94), plus the rate of climb capability of the aircraft.

At 140 this information is utilized to establish a third hazard avoidance maneuver area periphery as indicated at 140. At 142 it is determined whether or not the aircraft has arrived at that periphery. If the response is negative, the mode of display is continued as indicated at 144. If the response to the query is affirmative, the process steps 102–134 are performed as indicated at 146. However, in this performance the hazard avoidance maneuver area peripheries are computed on altitude and a possible rate of climb at least for the arrival at the second hazard avoidance maneuver area indicated at steps 104 and 110. Beyond that point the previously mentioned constraints on a hazard avoidance course are eliminated and the system proceeds as in step 112 to restart of the process without any constraints on hazard avoidance actions directed by the system, either via the pilot or the autopilot.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

What is claimed is:

1. A hazard avoidance system for use by an aircraft in flight, comprising:

a display;

sensors configured to provide data indicative of an altitude of the aircraft, a course of the aircraft, and a position of the aircraft; and a computer system including a processor and a generator configured to provide moving map data indicative of a topography of an area surrounding the position of the aircraft;

wherein said computer system is configured to perform the steps of:

determining a hazard zone based on the course of the aircraft and the altitude of the aircraft;

generating a display of hazards within the hazard zone based on the moving map data in a first display mode;

detecting a proximate hazard from among the hazards within the hazard zone at a predetermined distance from the aircraft and in or dangerously proximate to the course of the aircraft; and altering, in response to the detecting, the display of hazards to create a visual change in appearance of the proximate hazard contrasting to other of the hazards.

2. The hazard avoidance system of claim 1, wherein said altering the display of hazards includes removing the other of the hazards from the display.

3. The hazard avoidance system of claim 1, wherein said altering the display of hazards includes display the proximate hazard in a second display mode that is more emphasized than the first display mode.

4. The hazard avoidance system of claim 1, wherein the computer system is further configured to perform the step of generating a display of features of topography beneath the hazard zone in a second de-emphasized display mode contrasting to the first display mode.

5. The hazard avoidance system of claim 4, wherein the computer system is further configured to perform the step of removing from the display of the features, in response to the detecting, information indicative of at least one feature of the features.

6. The hazard avoidance system of claim 1, wherein:

the sensors are further configured to provide data indicative of a speed of the aircraft; and the detecting the proximate hazard includes detecting the proximate hazard based further on the speed of the aircraft and the position of the proximate hazard at which a hazard avoidance action by the aircraft is desirable.

7. The hazard avoidance system of claim 6, wherein the computer is further configured to perform the steps of:

determining a course of action to avoid the proximate hazard; and communicating the course of action to the observer.

8. The hazard avoidance system of claim 7, wherein communicating the course of action includes audibly communicating the course of action.

9. A hazard avoidance apparatus for use by an aircraft in flight, comprising:

a display;

a sensor port for receiving data indicative of an altitude of the aircraft, a course of the aircraft, and a position of the aircraft; and a computer system including a processor and a generator configured to provide moving map data indicative of a topography of an area surrounding the position of the aircraft;

wherein said computer system is configured to perform the steps of:

determining a hazard zone based on the course of the aircraft and the altitude of the aircraft;

generating a display of hazards within the hazard zone based on the moving map data in a first display mode;

detecting a proximate hazard from among the hazards within the hazard zone at a predetermined distance from the aircraft and in or dangerously proximate to the course of the aircraft; and altering, in response to the detecting, the display of hazards to create a visual change in appearance of the proximate hazard contrasting to other of the hazards.

10. The hazard avoidance apparatus of claim 9, wherein said altering the display of hazards includes removing the other of the hazards from the display.

11. The hazard avoidance apparatus of claim 9, wherein said altering the display of hazards includes display the proximate hazard in a second display mode that is more emphasized than the first display mode.

12. The hazard avoidance apparatus of claim 9, wherein the computer system is further configured to perform the step of generating a display of features of topography beneath the hazard zone in a second de-emphasized display mode contrasting to the first display mode.

13. The hazard avoidance apparatus of claim 12, wherein the computer system is further configured to perform the step of removing from the display of the features, in response to the detecting, information indicative of at least one feature of the features.

14. The hazard avoidance apparatus of claim 9, wherein:

the sensors further receives data indicative of a speed of the aircraft; and the detecting the proximate hazard includes detecting the proximate hazard based further on the speed of the aircraft and the position of the proximate hazard at which a hazard avoidance action by the aircraft is desirable.

15. The hazard avoidance apparatus of claim 14, wherein the computer is further configured to perform the steps of:

determining a course of action to avoid the proximate hazard; and communicating the course of action to the observer.

16. The hazard avoidance apparatus of claim 15, wherein communicating the course of action includes audibly communicating the course of action.

17. A hazard avoidance method by an aircraft in flight, comprising:

receiving data indicative of an altitude of the aircraft, a course of the aircraft, and a position of the aircraft;

providing moving map data indicative of a topography of an area surrounding the position of the aircraft;

determining a hazard zone based on the course of the aircraft and the altitude of the aircraft;

generating a display of hazards within the hazard zone based on the moving map data in a first display mode;

detecting a proximate hazard from among the hazards within the hazard zone at a predetermined distance from the aircraft and in or dangerously proximate to the course of the aircraft; and altering, in response to the detecting, the display of hazards to create a visual change in appearance of the proximate hazard contrasting to other of the hazards.

18. The hazard avoidance method of claim 17, wherein said altering the display of hazards includes removing the other of the hazards from the display.

19. The hazard avoidance method of claim 17, wherein said altering the display of hazards includes redisplaying the proximate hazard in a second display mode that is more emphasized than the first display mode.

20. The hazard avoidance method of claim 17, further comprising generating a display of features of topography beneath the hazard zone in a second de-emphasized display mode contrasting to the first display mode.

21. The hazard avoidance method of claim 20, further comprising the step of removing from the display of the features, in response to the detecting, information indicative of at least one feature of the features.

22. The hazard avoidance method of claim 17, further comprising receiving data indicative of a speed of the aircraft;

wherein said detecting the proximate hazard includes detecting the proximate hazard based further on the speed of the aircraft and the position of the proximate hazard at which a hazard avoidance action by the aircraft is desirable.

23. The hazard avoidance method of claim 22, further comprising:

determining a course of action to avoid the proximate hazard; and communicating the course of action to the observer.

24. The hazard avoidance method of claim 23, wherein said communicating the course of action includes audibly communicating the course of action.

25. A computer program product for implementing hazard avoidance by an aircraft in flight, comprising:

a computer readable medium; and a computer program stored in the medium including:

instructions for receiving data indicative of an altitude of the aircraft, a course of the aircraft, and a position of the aircraft;

instructions for providing moving map data indicative of a topography of an area surrounding the position of the aircraft;

instructions for determining a hazard zone based on the course of the aircraft and the altitude of the aircraft;

instructions for generating a display of hazards within the hazard zone based on the moving map data in a first display mode;

instructions for detecting a proximate hazard from among the hazards within the hazard zone at a predetermined distance from the aircraft and in or dangerously proximate to the course of the aircraft; and instructions for altering, in response to the detecting, the display of hazards to create a visual change in appearance of the proximate hazard contrasting to other of the hazards.

26. The computer program product of claim 25, wherein the instructions for altering the display of hazards includes instructions for removing the other of the hazards from the display.

27. The computer program product of claim 25, wherein the instructions for altering the display of hazards includes instructions for redisplaying the proximate hazard in a second display mode that is more emphasized than the first display mode.

28. The computer program product of claim 25, further comprising instructions for generating a display of features of topography beneath the hazard zone in a second de-emphasized display mode contrasting to the first display mode.

29. The computer program product of claim 28, further comprising instructions for removing from the display of the features, in response to the detecting, information indicative of at least one feature of the features.

30. The computer program product of claim 25, further comprising instructions for receiving data indicative of a speed of the aircraft;

wherein the instructions for detecting the proximate hazard includes instructions for detecting for the proximate hazard based further on the speed of the aircraft and the position of the proximate hazard at which a hazard avoidance action by the aircraft is desirable.

31. The computer program product of claim 30, further comprising:

instructions for determining a course of action to avoid the proximate hazard; and instructions for communicating the course of action to the observer.

32. The computer program product of claim 31, wherein the instructions for communicating the course of action includes instructions for audibly communicating the course of action.

* * * * *